US012714197B1

(12) United States Patent
Otto

(10) Patent No.: US 12,714,197 B1
(45) Date of Patent: Aug. 25, 2026

(54) HIGH HEELED SHOE

(71) Applicant: Jennifer Otto, Maineville, OH (US)

(72) Inventor: Jennifer Otto, Maineville, OH (US)

( * ) Notice: Subject to any disclaimer, the term of this patent is extended or adjusted under 35 U.S.C. 154(b) by 5 days.

(21) Appl. No.: 18/228,145

(22) Filed: Jul. 31, 2023

Related U.S. Application Data

(60) Provisional application No. 63/394,094, filed on Aug. 1, 2022.

(51) Int. Cl.
*A43B 21/30* (2006.01)

(52) U.S. Cl.
CPC ..... *A43B 21/30* (2013.01)

(58) Field of Classification Search
CPC ..... A43B 21/26; A43B 21/30; A43B 13/182
USPC ..... 36/27
See application file for complete search history.

(56) References Cited

U.S. PATENT DOCUMENTS

| | | | | |
|---|---|---|---|---|
| 2,721,400 | A * | 10/1955 | Israel | A43B 13/182 36/169 |
| 3,043,024 | A | 7/1962 | Haug, Jr. | |
| 3,174,235 | A | 3/1965 | Johnston | |
| 4,219,945 | A | 9/1980 | Rudy | |
| 4,848,008 | A | 7/1989 | Kuehnle et al. | |
| 4,876,805 | A | 10/1989 | Peoples | |
| 5,063,691 | A | 11/1991 | Haug | |
| 5,435,079 | A | 7/1995 | Gallegos | |
| 7,140,125 | B2 | 11/2006 | Singleton et al. | |
| 7,159,338 | B2 | 1/2007 | LeVert et al. | |
| 7,219,447 | B2 * | 5/2007 | LeVert | A43B 7/1425 36/27 |
| 7,290,354 | B2 | 11/2007 | Perenich | |
| 10,493,322 | B2 | 12/2019 | Yang | |
| 10,537,156 | B2 | 1/2020 | Thappeta | |

(Continued)

FOREIGN PATENT DOCUMENTS

| | | | |
|---|---|---|---|
| CN | 201153558 | Y | 11/2008 |
| CN | 201691161 | U | 1/2011 |

(Continued)

OTHER PUBLICATIONS

English Translation of KR20140097042 (Year: 2014).*
Edge Research, "Public Opinion Research on Foot Health and Care", APMA, Mar. 2014 (30 pages).

*Primary Examiner* — Ted Kavanaugh
(74) *Attorney, Agent, or Firm* — Daniel F. Nesbitt; Nesbitt IP LLC

(57) ABSTRACT

A high-heeled shoe having a sole with a heel portion and a forefoot portion, a shoe upper affixed around the periphery of an upper surface of the sole, a compressible high heel, fixed to the under surface in the heel portion of the sole, and a compressible forefoot mechanism, fixed to the under surface in the forefoot portion of the sole. The compressible forefoot mechanism has upper and lower forefoot members, with the upper surface of the upper forefoot member fixed to the under surface in the forefoot portion of the sole, and lower forefoot member having a lower contact surface. A plurality of compressible forefoot springs are positioned between the upper and lower forefoot members. The compressible high heel has a cylinder housing a compressible heel spring and a piston having a stem extending through an opening in the bottom of the cylinder that provides a contact surface.

11 Claims, 3 Drawing Sheets

(56) References Cited

U.S. PATENT DOCUMENTS

| | | | | |
|---|---|---|---|---|
| 2002/0073579 | A1* | 6/2002 | Lombardino | A43B 13/182 36/28 |
| 2002/0083616 | A1 | 7/2002 | Hajianpour | |
| 2005/0204584 | A1* | 9/2005 | Ryoo | A43B 7/20 36/27 |
| 2009/0119947 | A1 | 5/2009 | Orvitz | |
| 2009/0126228 | A1 | 5/2009 | Lee | |
| 2012/0055048 | A1 | 3/2012 | Haupt et al. | |
| 2013/0160332 | A1 | 6/2013 | Yoon | |
| 2014/0196319 | A1 | 7/2014 | Rupprecht | |
| 2017/0065024 | A1* | 3/2017 | Binder | A43B 7/1425 |
| 2017/0119099 | A1 | 5/2017 | Ferguson | |
| 2019/0110555 | A1 | 4/2019 | Chiang et al. | |
| 2021/0037914 | A1 | 2/2021 | Adametz et al. | |
| 2022/0151340 | A1 | 5/2022 | Go | |
| 2023/0000204 | A1 | 1/2023 | Le et al. | |

FOREIGN PATENT DOCUMENTS

| | | | | |
|---|---|---|---|---|
| CN | 102972916 | A | | 3/2013 |
| CN | 208891769 | U | | 5/2019 |
| CN | 112586833 | A | | 4/2021 |
| CN | 214904184 | U | | 11/2021 |
| CN | 215124857 | U | | 12/2021 |
| DE | 20312215 | U1 | | 1/2004 |
| KR | 200299397 | | | 1/2003 |
| KR | 200299397 | Y1 | | 1/2003 |
| KR | 1020060103305 | A | | 9/2006 |
| KR | 1020060113126 | A | | 11/2006 |
| KR | 100865677 | | | 10/2008 |
| KR | 100973724 | | | 8/2010 |
| KR | 100999901 | | | 12/2010 |
| KR | 101129991 | | | 3/2012 |
| KR | 1020120063413 | A | | 6/2012 |
| KR | 1020120063417 | A | | 6/2012 |
| KR | 10-1164112 | B1 | | 7/2012 |
| KR | 2020130005940 | | | 10/2013 |
| KR | 20140097042 | A | * | 8/2014 |
| KR | 20-0477324 | Y1 | | 6/2015 |
| KR | 101524229 | B1 | | 6/2015 |
| KR | 1020200056162 | | | 5/2020 |
| WO | 2009082164 | A1 | | 7/2009 |
| WO | 2010122527 | A2 | | 10/2010 |
| WO | 2020076050 | A1 | | 4/2020 |
| WO | 2020080726 | A1 | | 4/2020 |
| WO | 2020085682 | A1 | | 4/2020 |
| WO | 2020130636 | A1 | | 6/2020 |
| WO | 2020189885 | A1 | | 9/2020 |
| WO | 2020246680 | A1 | | 12/2020 |
| WO | 2020246682 | A1 | | 12/2020 |
| WO | 2021157986 | A1 | | 8/2021 |

* cited by examiner

HIGH HEELED SHOE

CROSS-REFERENCE TO RELATED APPLICATION

This application claims the benefit of U.S. Provisional Application 63/394,094, filed Aug. 1, 2022, the disclosure of which is incorporated by reference in its entirety.

BACKGROUND OF THE INVENTION

According to a 2014 survey by the American Podiatric Medical Association, 71 percent of women who wear high heels claim the shoes hurt their feet. (APMA Public Opinion Research on Foot Health and Care Findings from a Survey of 1000 US Adults, Edge Research, March 2014, the disclosure of which is incorporated by reference in its entirety). Yet the average high-heeled shoe wearer owns nine pair, and 38 percent claim they'd wear the shoes even if they hurt. High-heeled shoes have been associated with bunions, hammertoes, shortened Achilles tendon, and fractures, sprains, and knee/hip/back pain due to the forward pitch of the high-heeled shoe design.

High-heeled shoes, in addition to being uncomfortable, are associated with more significant health-related outcomes. In one report " . . . the high-heeled shoe group suffered more pain than the controls in the lesser toes and the mid-foot. A potential explanation for the pain in the mid-foot is the windlass mechanism; wearing high-heeled shoes flexes the MTP joints and may cause painful tension in the plantar fascia." (Grethe E. Borchgrevink, Annja T. Viset, Eivind Witso, Berit Schei, Olav A. Foss. Does the use of high-heeled shoes lead to fore-foot pathology? A controlled cohort study comprising 197 women. Elsevier, Oct. 28, 2015, the disclosure of which is incorporated by reference in its entirety).

In another report "(w) omen who reported wearing high-heeled shoes as the main shoe during ages 20-64 years (always) had increased odd of HV [hallux valgus*] by 47% (P=0.01), after adjusting for other factors." (Alyssa B. Dufour, Virginia A. Casey, Yvolle M. Golightly, and Marian T. Hannan. Characteristics Associated With Hallux Valgus in a Population-Based Foot Study of Older Adults, American College of Rheumatology, December 2014, the disclosure of which is incorporated by reference in its entirety). Hallux valgus is a progressive foot deformity in which the first metatarsophalangeal (MTP) joint is affected and is often accompanied by significant functional disability and foot pain and reduced quality of life." (Physio-pedia.com).

In yet another report, "(s)ystematic increases in the active vertical, propulsive, and braking forces were found as shoe height increased." (Darren J. Stefanyshyn, Benno M. Nigg, Veronica Fisher, Barry O'Flynn, Wen Liu. The Influence of High Heeled Shoes on Kinematics, Kinetics, and Muscle EMG of Normal Female Gait. Human Kinetics Journal, Volume 16, Issue 3, the disclosure of which is incorporated by reference in its entirety).

Prior art attempts to address the need for a comfortable high-heeled shoe have provided less heel cushioning, as described in U.S. Pat. Nos. 3,043,024 and 3,174,235, incomplete comfort delivery, as described in International Patent Publication WO2020080726A1, or a compromise in aesthetics, as described in U.S. Pat. No. 5,063,691, the disclosures of which are incorporated by reference in their entirety.

Prior art attempts to provide for a resilient element (e.g., a spring) in the forefoot portion of a shoe have built such elements into the forefoot sole of the shoe, as describe in German Patent Publication DE20312215U1, Chinese Patent Publication CN201153558Y, Chinese Utility Model Publication CN201691161U, and Korean Utility Model Publication KR2020-130005940U; or have provided a pair of identical spring elements, one each at both the forefoot portion and the heel portion of the shoe, as described in U.S. Patent Publication 2002-0083616-A1 and Korean Patent Publication KR200299397Y1, the disclosures of which are incorporated by reference in their entirety.

Thus, there remains a need for a more comfortable high-heeled shoe. This device overcomes the shortcomings of prior art shock-absorbing or cushioning devices by providing a more effective comfort-delivering structure without compromising aesthetic appeal.

SUMMARY OF THE INVENTION

The invention includes a high-heeled shoe that comprises: a sole having a heel portion and a forefoot portion, an upper surface, and an under surface; a shoe upper affixed around the periphery of the upper surface of the sole; a compressible high heel, fixed to the under surface in the heel portion of the sole; and a compressible forefoot mechanism, fixed to the under surface in the forefoot portion of the sole.

In various embodiments of the high-heeled shoe, the compressible forefoot mechanism comprises an upper member having an upper surface fixed to the under surface in the forefoot portion of the sole, a lower forefoot member having a lower contact surface, and a plurality of compressible forefoot springs disposed between a lower surface of the upper member and an upper surface of the lower forefoot member, wherein the lower forefoot member moves toward the upper member in response to an upward stepping force against the lower contact surface of the lower forefoot member, compressing the plurality of compressible forefoot springs.

In any one or a combination of the above embodiments of the high-heeled shoe, the compressible high heel comprises a cylinder comprising an upper end and a lower end having a lower opening, a compressible heel spring disposed within the upper end of the cylinder, and a piston comprising a plunger disposed within the lower end of the cylinder, and a stem extending from a lower end of the plunger, and through the lower opening in the cylinder, and a retaining plate comprising a means for removably attaching the retaining plate to the lower end of the cylinder, and having a bore through the retaining plate, wherein the stem extends through the bore of the retaining plate. A distal end of the plunger provides a contact surface, wherein the piston moves upward within the cylinder in response to an upward stepping force against the distal end of the plunger, compressing the compressible heel spring.

In any one or a combination of the above embodiments of the high-heeled shoe, the lower forefoot member has a width the same as, and aligned with, the width of the forefoot portion of the sole.

In any one or a combination of the above embodiments, the plurality of compressible forefoot springs distribute the stepping force evenly upon the forefoot portion of the sole of the shoe.

The design of the high-heel shoe according to the present invention provides increased walking and post-wear comfort based on an interaction between a decreased heel impact, a decreased forefront impact, and a reduced forward posture pitch. Two functional elements collectively address these high-heeled shoe risks: (1) a spring-based shock-absorbing heel, and (2) a spring-based shock-absorbing forefoot platform. A combination of the high heel and the forefoot platform provides a reduced pitch angle (α) between the back of the user's heel and the front of the forefoot, as compared to a conventional high-heel shoe.

DETAILED DESCRIPTION OF THE INVENTION

Figure 1:
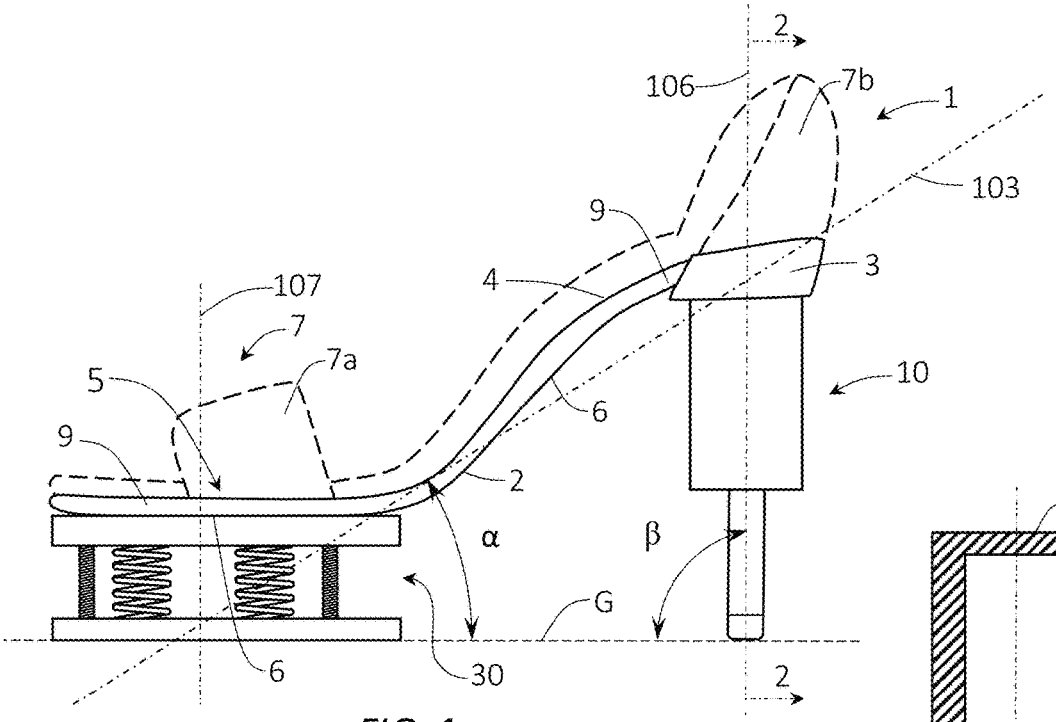
FIG. 1 illustrates a high-heeled shoe having a sole with a heel portion and a forefoot portion, and have a compressible high heel and a compressible forefoot mechanism.

FIG. 1 illustrates a high-heeled shoe 1 having a sole 2 having a heel portion 3 and a forefoot portion 5, an upper surface 4, and an under surface 6. Affixed to the upper surface 4 of the sole 2 is a shoe upper 7 affixed around the upper surface 4 at the periphery 9 of the sole 2. The shoe upper 7 includes a forefoot upper 7*a* affixed around the upper surface 4 at the periphery 9 of the forefoot portion 5 of the sole 2, and a heel upper 7*b* affixed around the upper surface 4 at the periphery 9 of the heel portion 3 of the sole 2. Affixed to an under surface 6 of the heel portion 3 of the sole 2 is a compressible high heel 10, and affixed to the under surface 6 of the forefoot portion 5 of the sole 2 is a compressible forefoot mechanism 30.

It should be understood that the shoe upper 7 is illustrated in FIG. 1 as an open-toed shoe upper 7*a*, which is a separate structure from the heel upper 7*b*, though a shoe upper element of the present invention can be any shoe upper, include a single structure element that has either an open-toe or closed-toe construction, or a single structure element that is position around the entire periphery of the sole, or only in the forefoot portion 5 of the sole 2, or some combination thereof.

<Compressible High Heel>

Figure 4:
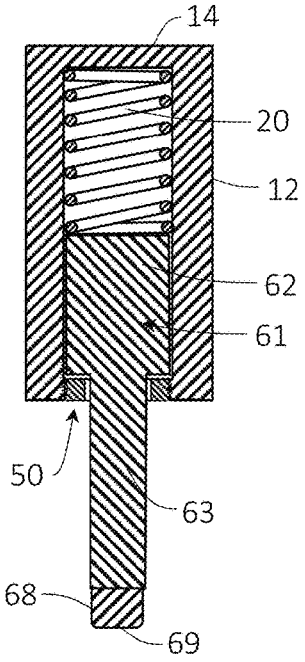
FIG. 4 illustrates the heel compressible high heel of FIG. 2 in a compressed state.
Figure 3:
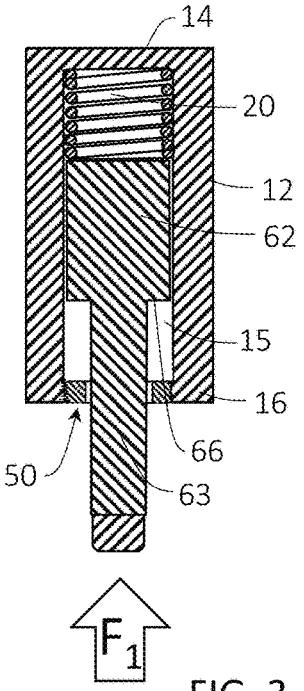
FIG. 3 illustrates the heel compressible high heel of FIG. 2 in an uncompressed state.
Figure 2:
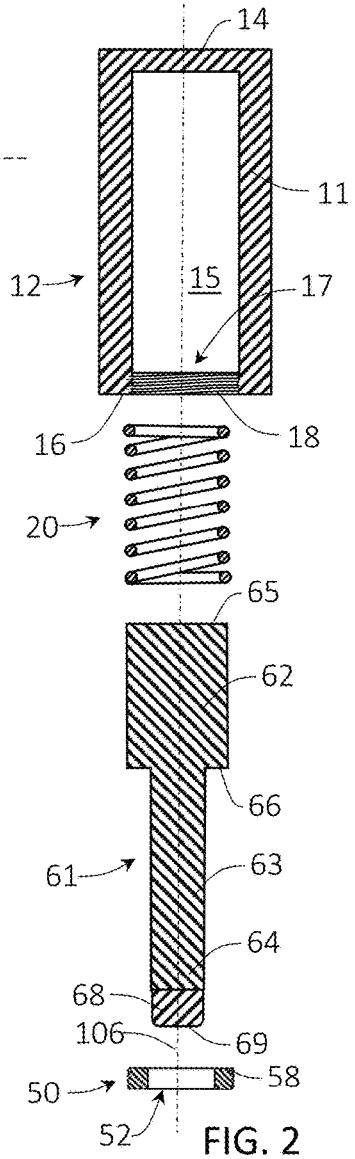
FIG. 2 illustrates a sectional view of the heel compressible high heel, viewed through line 2-2 of FIG. 1.

FIGS. 2-4 illustrate the compressible high heel 10, comprising a cylinder 12 having an elongated cylindrical (circular) cavity 15 defined by a closed upper end 14, a cylindrical sidewall 11, and a lower end 16 having a lower opening 17 of approximately the lateral diameter or cross-sectional size of the cavity 15. The inner sidewalls of the lower end 16 include helical threads 18 that define the perimeter of the opening 17. A compressible heel spring 20 can be inserted into the cavity 15 through the opening 17 and positioned within the upper end of the cavity 15 of the cylinder 12.

A piston 61 at an upper end includes a plunger 62 having an upper surface 65 and a lower shoulder 66. The plunger 62 of the piston 61 is inserted into the cavity 15 through the opening 17 and secured within the lower end of the cavity 15 of the cylinder 12. The piston 61 also includes a stem 63 having a distal end 64, and a diameter or other cross-sectional shape of a size that is smaller than the diameter or other cross-sectional shape of the plunger 62. The stem 63 extends from the lower end of the upper plunger 62 and through the lower opening 17 in the cavity 15 of the cylinder 12. Typically, the plunger 62 and the stem 63 have a common centerline 106. A replaceable piece 68 is fixed to the distal end 64 of the stem 63 to provide a ground-contact surface 69.

The heel spring 20 and the piston 61 are retained and secured within the cavity 15 using a retaining plate 50. The retaining plate 50 has a bore 52 through its center, and includes a means for securing removably and selectively the retaining plate 50 to the lower opening 17 of the cavity 15. In the illustrated embodiment, the securing means is a helical outward-facing thread 58 on the outside sidewall of the retaining plate 50 that engages and threadedly mates with the inwardly-facing threads 18 at the lower end 16 of the cylinder 12, for securing removably the retaining plate 50 to the lower end 16 of the cylinder 12. The retaining plate 50 covers the opening 17 and the body of the retaining plate 50 surrounding the bore 52 obstructs the lower shoulder 66 of the plunger 62, thereby retaining the piston 61 within the cavity 15. The bore 52 is a diameter or other cross-sectional size, through which the stem 63 extends fully (FIG. 3) without frictional contact with the body of the retaining plate 50, with the lower shoulder 66 constrained by the body of the retaining plate 50.

When an upward force $F_1$ resulting from compressive contact of the high heel 10 with the ground G or other walking surface (without limitation, a floor, sidewalk, walkway, or roadway), as shown in FIG. 3, the plunger 62 moves upward within the cavity 15 of the cylinder 12, and the upper surface 65 of the plunger 62 compresses the compressible heel spring 20 in response to the upward force $F_1$ exerted by the ground G against the force of the wearer's heel placed downward on the heel portion 3 of the sole 2. The compressing of the heel spring 20 generates an equal and opposite compression force upon the upper surface 65 of the plunger, until an equilibrium is achieved between the upward force $F_1$ and the compression force of the heel spring 20, thereby reducing the intensity and suddenness of the impact of the wearer's heel on the heel portion 3 of the sole 2, such as while stepping in the shoe 1 onto the ground G.

In various embodiments, the cylinder 12 and piston 61 can be made of a rigid, high strength material or composite thereof, such as though not limited to a metal, such as though not limited to steel or aluminum, one or more thermoplastics, such as though not limited to polypropylene and polycarbonate, a thermoset plastic, such as though not limited to polyacrylic or epoxy, a ceramic material, and wood. The cavity 15 is preferably of a size that is just slightly larger in diameter than the diameter of the plunger 62 of the piston 61 to provide substantially frictionless axial movement, while maintaining axial alignment of the plunger 62 as it reciprocates axially within the cavity 15. The length of the cavity 15 is sufficient to retain both the plunger 62 and the heel spring 20 in a neutral, non-compressed state, or in a partially, though minimally, compressed state.

The compressible heel spring can be an industrial steel spring having an outer diameter of 0.25-0.75 inch. In various embodiments, the compressible heel spring 20 fits within and can be compressed within the cavity 15, and has an outer diameter that does not contact the inner surface of the sidewall 11 of the cavity 15 during compression. Typically, the length of the compressible heel spring 20 at its a neutral, non-compressed state is greater than the diameter of the cavity 15 to avoid the spring 20 tumbling sideways within the cavity 15. The heel spring 20 typically has a spring constant of about 30-70 kN/m (about 100-300 lbf/inch). Preferably the compression heel spring has a spring properties sufficient to absorb the weight of a 175 lb person with a spring deflection of between 0.5-1 inch. Larger or smaller spring constants and spring deflections can be used are needed or desired.

The attachment of the upper end 14 of the cylinder 12 to the under surface 6 in the heel portion 3 of the sole 2 can be secured by an adhesive means, such as though not limited to epoxy and acrylic adhesives, or by a mechanical means, such as though not limited to screws, nails, rivets, or a combination thereof. The compressible high heel 10 is fixed to under surface 6 in the heel portion 3 of the sole 2 to provide an angle β of the ground G with the centerline axis 106 through the high heel 10, with both the high heel 10 and the compressible forefoot mechanism 30 touching the ground G. Typically, the angle β is normal (90°), though is not less than 80°, more preferably not less than 85°, and most preferably not less than 87°.

<Compressible Forefoot Mechanism>

Figure 5:
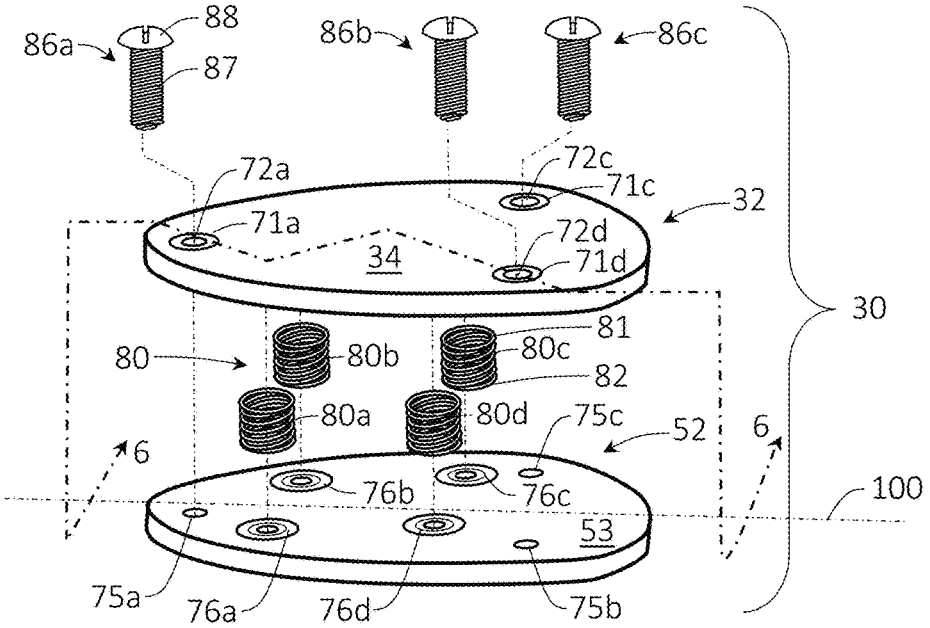
FIG. 5 illustrates an exploded view of the compressible forefoot mechanism.
Figure 6:
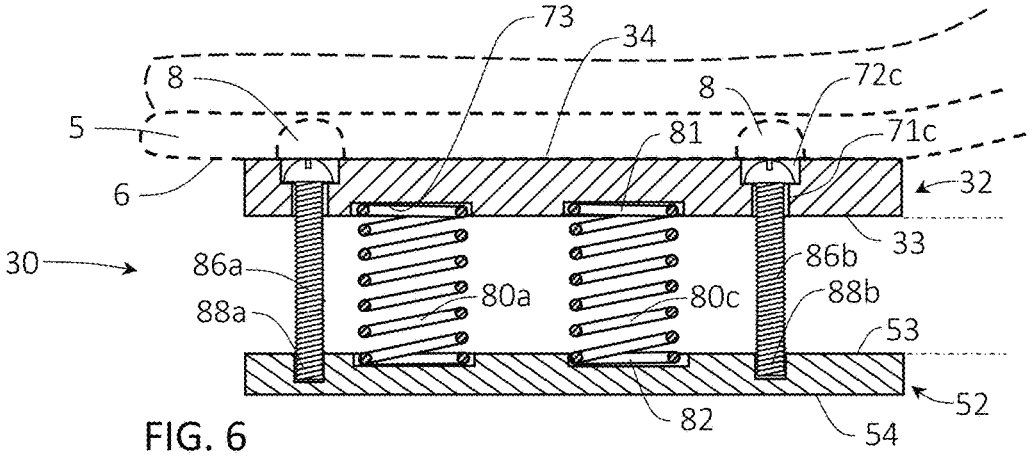
FIG. 6 illustrates a sectional view of the compressible forefoot mechanism, viewed through line 6-6 of FIG. 5, in an uncompressed state.
Figure 7:
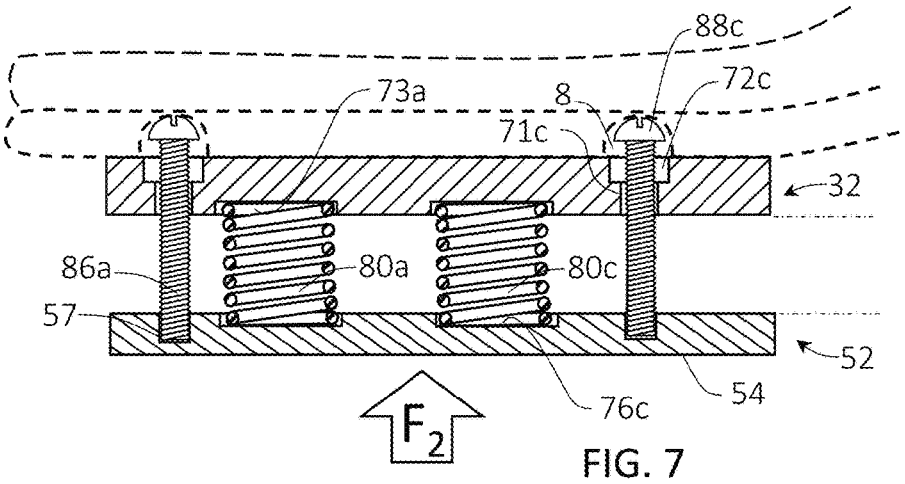
FIG. 7 illustrates the compressible forefoot mechanism of FIG. 6 in a compressed state.

FIGS. 5-7 illustrate the compressible forefoot mechanism 30, including an upper forefoot member 32 having an upper contact surface 34 that confronts and is fixed to the under surface 6 in the forefoot portion 5 of the sole 2 (FIG. 1), and an under surface 33; a lower forefoot member 52 having an upper surface 53 and a lower contact surface 54; and a plurality of resilient compressible elements, illustrated as helical compressible forefoot springs 80, disposed between the under surface 33 of the upper forefoot member 32 and the upper surface 53 of the lower forefoot member 52.

When an upward force $F_2$ is exerted onto the lower contact surface 54 of the lower forefoot member 52, as shown in FIG. 7, resulting from contact of the shoe's forefoot with the ground G during walking or stepping, the lower forefoot member 52 is configured to move in a general direction normal (transverse) to its upper surface 53, and toward the upper forefoot member 32, thereby compressing the plurality of compressible forefoot springs 80. The compressing of the compressible forefoot springs 80 reduces the intensity and suddenness of the impact of the wearer's forefoot in response to the upward stepping force $F_2$ against the lower contact surface 54 of the lower forefoot member 52 while stepping (or standing) in the shoe 1 onto ground G.

As shown in FIGS. 5-7, each of the plurality of compressible forefoot springs 80 has an upper end and a lower end formed from a respective upper coil 81 and a lower coil 82 of the forefoot spring 80. Each upper coil 81 is positioned in registry within a corresponding recessed groove 73 formed within the under surface 33 of the upper forefoot member 32, while each lower coil 81 is positioned in registry within a corresponding recessed groove 76 formed within the upper surface 53 of the lower forefoot member 52. The upper forefoot member 32 and the lower forefoot member 52 are position and secured together so that the recessed grooves 73 formed within the under surface 33 of the upper forefoot member 32 are aligned and registered with the recessed grooves 76 formed within the upper surface 53 of the lower forefoot member 52, and with the plurality of forefoot springs 80 positioned in between.

Figure 9:
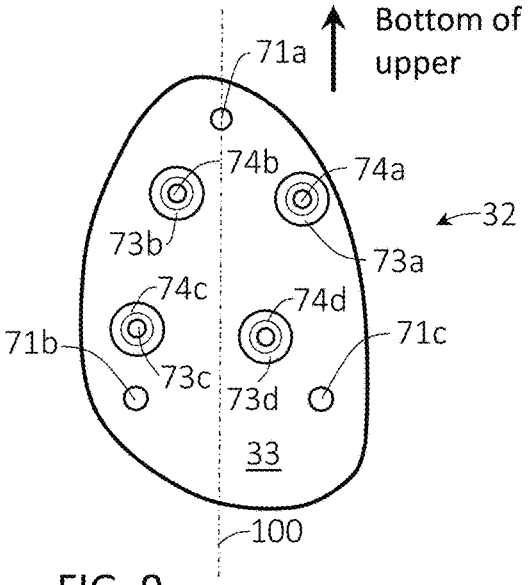
FIG. 9 illustrates a bottom plan view of an upper forefoot member of the compressible forefoot mechanism.

FIG. 9 shows a bottom plan view of the under surface 33 of the upper forefoot member 32 and the positioning of four recessed grooves 73 (73*a*, 73*b*, 73*c*, and 73*d*) formed into the under surface 33. At the center of each recessed groove 73 is a post 74 (74*a*, 74*b*, 74*c* and 74*d*) which aids in registering and aligning the respective upper coils 81 of forefoot springs 80 within the respective groove 73.

Figure 10:
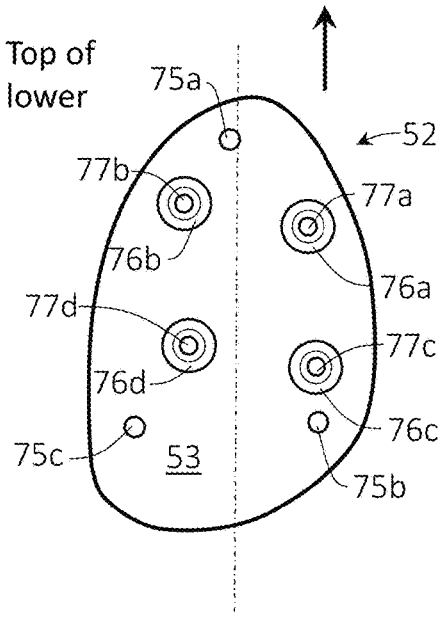
FIG. 10 illustrates a top plan view of a lower forefoot member of the compressible forefoot mechanism.

FIG. 10 shows a top plan view of the upper surface 53 of the lower forefoot member 52 and the positioning of the four recessed grooves 76 (76*a*, 76*b*, 76*c*, and 76*d*) formed into the upper surface 53. At the center of each recessed groove 76 is a post 77 (77*a*, 77*b*, 77*c* and 77*d*) which aids in registering and aligning the respective lower coils 82 of forefoot springs 80 within the respective groove 76. As can be seen by comparing FIGS. 9 and 10, the under surface 33 of the upper forefoot member 32 and the upper surface 53 of the lower forefoot member 52 are mirror images in terms of the peripheral shape, and of the positioning of the respective recessed grooves 73 and 76.

FIGS. 6 and 7 illustrate the securing of the upper forefoot member 32 to the lower forefoot member 52. The securing must prevent the lower forefoot member 52 from separating away from the upper forefoot member 32, while also allowing the lower forefoot member 52 to move upward and toward the upper forefoot member 32 when the upward force $F_2$ is exerted onto the lower contact surface 54. In the illustrated embodiment, a plurality of (three) threaded screws 86, each having a head 88 and a threaded stem 87, are inserted through a respective through hole 71 in the upper forefoot member 32 until the respective heads 88 rest within a respective recess 72 surrounding the through hole 71 and constraining the head 88 from further downward movement. The through holes 71 have a diameter (size) larger than the outer diameter (size) of the threaded stem 87, so that the threaded stem 87 extends through the through hole 71, and can move vertically within the through hole 71, without engagement or frictional contact.

The distal end of the three threaded stems 87*a*, 87*b*, 87*c* of the threaded screws 86 extend into and thread fixedly within a respective blind hole 75*a*, 75*b*, 75*c* formed into the upper surface 53 of the lower forefoot member 52. An adhesive can be added into the blind hole 75 to improve securement of the threaded screws 86. In an alternative embodiment, a blind hole of larger diameter can be formed to accept and retain a metal insert body (not shown) having a threaded bore, for improved securement of the threaded stem 87 to the lower forefoot member 52.

When the upward force $F_2$ is exerted onto the lower contact surface 54, the threaded stems 87 of the screws 86 is driven upwardly, which raises the heads 88 of the screws upwardly, and out of contact with the recesses 72 surrounding the through holes 71. In various embodiments, the depth of the recess 72 is sufficient to house and contain the head 88 of the screw 86 within the recess 72 and below the upper contact surface 34. In the illustrated embodiment, the full compression of the forefoot springs 80 can raise the head 88 of the threaded screw 86 upward and above the upper contact surface 34, and into a space occupied by the forefoot portion of the sole 2 of the shoe. In such embodiments, the undersurface of the forefoot portion 5 of the sole 2 can be hollowed out to form a small bore 8 (see FIG. 7) that allows the head 88 of the screw 86 to raise up above the upper contact surface 34 and into the bore 8, thereby avoiding contact between the head 88 and the sole 2.

FIGS. 5 and 8 through 10 illustrate the use of three threaded screws 86 (86*a*, 86*b*, 86*c*) extending into through holes 71 (71*a*, 71*b*, 71*c*) and resting within recesses 72 (72*a*, 72*b*, 72*c*) of the upper forefoot member 32, with the distal end of the threaded stems 87 extending into and securing within respective three blind holes 75 (75*a*, 75*b*, 75*c*) in the lower forefoot member 52. As can be seen by comparing FIGS. 9 and 10, the under surface 33 of the upper forefoot member 32 and the upper surface 53 of the lower forefoot member 52 are mirror images in terms of the positioning of the through holes 71 (71*a*, 71*b*, 71*c*) in the under surface 33, and the blind holes 75 (75*a*, 75*b*, 75*c*) in the upper surface 53.

Figure 8:
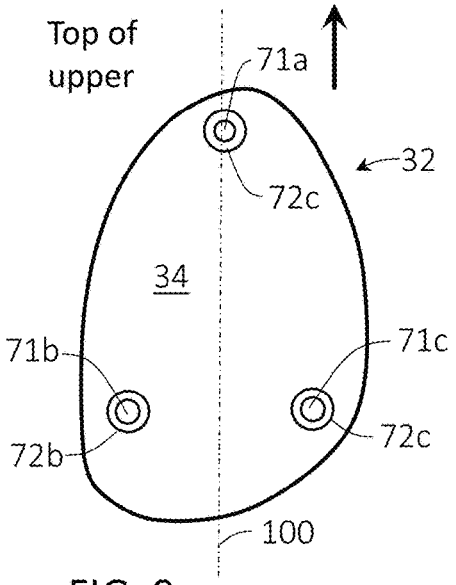
FIG. 8 illustrates a top plan view of an upper forefoot member of the compressible forefoot mechanism.
Figure 11:
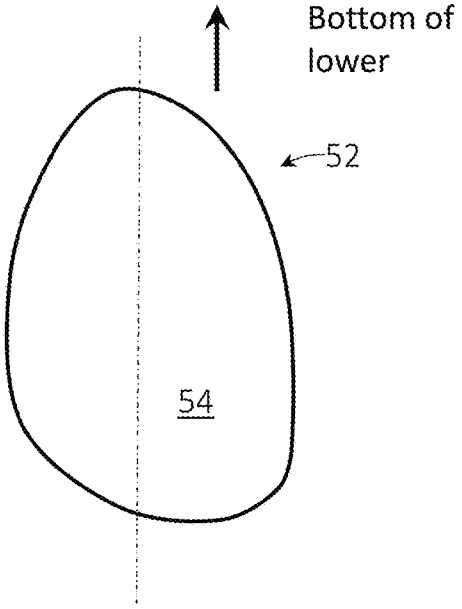
FIG. 11 illustrates a bottom plan view of a lower forefoot member of the compressible forefoot mechanism.

FIGS. 8 and 9 show both the upper contact surface 34 and under surface 33 of the upper forefoot member 32, and FIGS. 10 and 11 show the upper surface 53 and lower contact surface 54 of the lower forefoot member 52. The upper contact surface 34 of the upper forefoot member 32, shown in FIG. 8, is the surface that attaches to the underside 6 of the forefoot portion 5 of the shoe sole 2. The attachment of the upper contact surface 34 of the upper forefoot member 32 to the underside 6 of the forefoot portion 5 of the sole 2 of the shoe can be secured by an adhesive means, such as though not limited to epoxy and acrylic adhesives, by a mechanical means such as though not limited one or more from a group consisting of screws, nails, rivets, stitching, and a combination thereof, or a combination thereof.

In various embodiments, the material of the upper and lower forefoot members 32,52 can be the same or different, and comprise a material selected from the groups consisting of rubbers such as though not limited to N-butyl, leather, thermoplastics and thermosets such as though not limited to polyvinyl chloride, thermoplastic polyurethane, bi-component polyurethane, and EVA (ethylene vinyl acetate) polymers, metals such as though not limited to aluminum, steel, and alloys thereof, and wood. The thickness of the upper and lower forefoot members can be varied as desired, or as needed to maintain rigidity and resilience. A typical thickness of the upper and lower forefoot members is about 0.20-0.50 inches. The lateral and length dimensions of the upper and lower forefoot members will vary somewhat depending upon the size of the shoe, though for a size 7 (US standard) shoe, the lateral width is about 2.5 inches and the length is about 4 inches.

In various embodiments, the upper forefoot member 32 has a same width and length of the lower forefoot member 52, and preferably the lower surface 34 of the upper forefoot member 32 is the mirror image of the upper surface 54 of the upper forefoot member 52, and the two forefoot members 32,52 are aligned and in registry with one another and with the forefoot portion 5 of the sole 2.

In various embodiments, the plurality of compressible forefoot springs 80 can be an industrial steel spring having an outer diameter of 0.25-0.75 inch typically, though larger diameter springs may be used, and a spring constant of about 10-40 kN/m (about 50-200 pounds force (lbf)/inch). The length of compressible forefoot spring can also vary depending on the spring factor, though typically the length is a function of the spring diameter, and is typically a length of about one to two times the diameter in the equilibrium (uncompressed and unrestrained) state. Preferably the plurality of compression forefoot springs in each (the left-footed shoe and the right-footed shoe) of the compressible forefoot mechanisms have a spring properties sufficient to absorb the weight of a 175-pound (lb) person with a spring deflection of between 0.5-1 inch. The shock force-dissipating characteristics of the high heeled shoe can be customized or varied, to accommodate the walking style and body weight of any user, by provide for or changing the spring factor(s) of one or more of the plurality of compressible forefoot springs and the number of forefoot springs used.

The illustrated embodiment shows the use of four forefoot spring members in each compressible forefoot mechanism, though fewer, or more, can be used. Two forefoot springs 80*a*, 80*c* are placed to the left of the center line 100 of the ball assembly, and two forefoot springs 80*b*, 80*d* are placed to the right of the center line 100 of the ball assembly. The forefoot springs are approximately equidistant apart, each ranging from 10-40% in from the outer edge of the upper and lower forefoot members and from 10-40% in from the front (the direction of the arrow) or back of the upper and lower forefoot member, depending on the size of the shoe. The exact dimensions and locations are selectively spaced. The four-spring design and exact placement of forefoot springs can be optimized for the most comfortable weight distribution, balance, and security for the wearer, depending on the shoe size and heel height, wherein the distribution of the stepping force is evenly distributed evenly upon the forefoot portion of the sole. Less than four forefoot springs was used and seemed to slightly compromise balance. More than four forefoot springs was used and was judged not to provide any significant improvement in balance or feel.

The combination of the high heel and the forefoot platform provides a reduced pitch angle ($\alpha$), as shown in FIG. 1, between the back of the user's heel and the front of the forefoot, as compared to a conventional high-heel shoe, which reduces the forward pitch of the foot. Two functional elements collectively address these high-heeled shoe risks: (1) a spring-based shock-absorbing heel, and (2) a spring-based shock-absorbing forefoot platform. A combination of the high heel and the forefoot platform provides a reduced pitch angle ($\alpha$) between the back of the user's heel and the front of the forefoot, as compared to a conventional high-heel shoe having a high heel of the same height, while maintaining the overall height advantage provided by the high heel to the user. The pitch angle ($\alpha$) is typically at or between 25 to 45 degrees, and preferably about 32 to about 33 degrees.

I claim:

1. A high-heeled shoe, comprising:

a sole having a heel portion and a forefoot portion, an upper surface, and an under surface;

a shoe upper affixed around the periphery of the upper surface of the sole;

a compressible high heel, fixed to the under surface in the heel portion of the sole, the compressible high heel comprising a cylinder comprising an upper end and a lower end having a lower opening, a compressible heel spring disposed within the upper end of the cylinder, and a piston comprising a plunger disposed within the lower end of the cylinder, and a stem extending from the plunger through the lower opening in the cylinder, the stem having a distal end, and a retaining plate comprising a means for securing removably the retaining plate to the lower end of the cylinder, and having a bore through the retaining plate through which the stem extends, wherein the distal end of the stem provides a contact surface, and wherein the plunger of the piston moves upward within the cylinder in response to an upward stepping force against the distal end of the stem of the piston, compressing the compressible heel spring; and a compressible forefoot mechanism, fixed to the under surface in the forefoot portion of the sole.

2. The high-heeled shoe according to claim 1, wherein the compressible forefoot mechanism comprises an upper forefoot member having an upper surface fixed to the under surface in the forefoot portion of the sole, a lower forefoot member having a lower contact surface, and a plurality of compressible forefoot springs disposed between an under surface of the upper forefoot member and an upper surface of the lower forefoot member, wherein the lower forefoot member moves toward the upper forefoot member, compressing the plurality of compressible forefoot springs.

3. The high-heeled shoe according to claim 2, wherein the forefoot springs are compressed in response to the upward stepping force against the lower contact surface of the lower forefoot member.

4. The high-heeled shoe according to claim 2, wherein the lower forefoot member has a width the same as, and aligned with, the width of the forefoot portion of the sole.

5. The high-heeled shoe according to claim 2, wherein at least two compressible forefoot springs are placed to the left of a centerline of the compressible forefoot mechanism, and at least two compressible forefoot springs are placed to the right of the centerline of the compressible forefoot mechanism, whereby the stepping force is distributed evenly upon the forefoot portion of the sole.

6. The high-heeled shoe according to claim 5 wherein the forefoot springs have a spring constant of about 10-40 kN/m and can be changed to vary the shock force-dissipating characteristics of the shoe based on the weight of a user.

7. The high-heeled shoe according to claim 2 wherein the heel spring has a spring constant of about 30-70 kN/m.

8. The high-heeled shoe according to claim 2 wherein the compressible high heel is fixed to an under surface in the heel portion of the sole to provide an angle $\beta$ between a ground surface G under the f compressible forefoot mechanism and a centerline axis through the high heel of not less than 87°.

9. The high-heeled shoe according to claim 2 wherein the compressible forefoot springs comprise helical compressible forefoot springs.

10. The high-heeled shoe according to claim 2 wherein a pitch angle $\alpha$ between the back of the user's heel and the front of the user's forefoot, while wearing the high-heeled shoe, is between 25 to 45 degrees.

11. The high-heeled shoe according to claim 10 wherein the pitch angle $\alpha$ is about 32 to about 33 degrees.

* * * * *